US009066604B2

(12) United States Patent
Chen

(10) Patent No.: US 9,066,604 B2
(45) Date of Patent: Jun. 30, 2015

(54) BABY SWING AND BOUNCER

(76) Inventor: Jung Tsai Chen, Tainan (TW)

( * ) Notice: Subject to any disclaimer, the term of this patent is extended or adjusted under 35 U.S.C. 154(b) by 327 days.

(21) Appl. No.: 13/458,785

(22) Filed: Apr. 27, 2012

(65) Prior Publication Data

US 2013/0285425 A1 Oct. 31, 2013

(51) Int. Cl.

| | |
|---|---|
| ***A47C 3/02*** | (2006.01) |
| ***A47D 1/00*** | (2006.01) |
| ***A47D 13/10*** | (2006.01) |

(52) U.S. Cl.

CPC ..... *A47D 1/00* (2013.01); *A47D 13/107* (2013.01)

(58) Field of Classification Search

CPC ..... A47D 13/107; A47D 13/10; A47D 9/02; A47D 9/04; A47D 15/00

USPC ..... 297/258.1, 259.3, 260.2, 452.13

See application file for complete search history.

(56) References Cited

U.S. PATENT DOCUMENTS

| | | | | |
|---|---|---|---|---|
| 3,235,306 | A | 2/1966 | Chernivsky | |
| D337,894 | S | 8/1993 | Mariol | |
| 5,411,315 | A | 5/1995 | Greenwood | |
| 5,509,721 | A | 4/1996 | Huang | |
| 6,378,940 | B1 * | 4/2002 | Longoria et al. | 297/217.3 |
| 6,431,646 | B1 * | 8/2002 | Longoria | 297/217.3 |
| D468,544 | S | 1/2003 | Myers | |
| D492,851 | S | 7/2004 | Kane | |
| D604,055 | S | 11/2009 | Plested et al. | |
| 7,722,118 | B2 * | 5/2010 | Bapst et al. | 297/256.12 |
| D637,828 | S | 5/2011 | Horn et al. | |
| D651,817 | S | 1/2012 | Horn et al. | |
| 8,382,203 | B2 * | 2/2013 | Gilbert et al. | 297/260.2 |
| D680,764 | S | 4/2013 | Chen | |
| 8,661,582 | B2 * | 3/2014 | Sclare et al. | 5/101 |
| 2004/0217643 | A1 * | 11/2004 | Piwko et al. | 297/452.13 |
| 2005/0283908 | A1 * | 12/2005 | Wong et al. | 5/109 |
| 2007/0007804 | A1 * | 1/2007 | Pemberton et al. | 297/260.2 |
| 2011/0012408 | A1 * | 1/2011 | Lee et al. | 297/258.1 |
| 2013/0154324 | A1 * | 6/2013 | Xu | 297/259.3 |

* cited by examiner

*Primary Examiner* — Laurie Cranmer

(74) *Attorney, Agent, or Firm* — Chen Yoshimura LLP

(57) ABSTRACT

A baby swing and bouncer which includes a base to be places on a surface, a seat frame for carrying a seat for seating a child, two support leg disposed between the base frame and the seat frame for supporting the seat frame, and two connecting structure for coupling the seat frame to an upper end of the two support legs, respectively. A lower end of each support leg has a lower straight section rotatably coupled to the base frame, and an upper end of each support leg has an upper straight section rotatably coupled to a corresponding connecting structure. The rotation axes of the lower straight sections and the upper straight sections of the first and second support legs are parallel to each other. The relative rotations of at least one of the lower and upper straight sections of the two support legs are driven by a drive mechanism.

11 Claims, 12 Drawing Sheets

BABY SWING AND BOUNCER

BACKGROUND OF THE INVENTION

1. Field of the Invention

This invention relates to a bouncer and swing for babies.

2. Description of the Related Art

Various baby swing designs are known. In one type of design, a baby seat is hung from a relatively high frame and swings around a pivot point located above the seat. See, for example, U.S. Pat. Appl. Pub. Nos. 2004/0102253, 2004/0198513, and 2007/0129156. In another type of design, a baby seat is supported by an arm which rotates around a substantially vertical axis to create a swing motion. See, for example, U.S. Pat. Nos. 7,563,170, 7,824,273, 7874927 and U.S. Pat. Appl. Pub. Nos. 20070111809 and 20080146359.

SUMMARY OF THE INVENTION

The present invention provides a baby swing and bouncer which includes: a base to be places on a surface; a seat frame for carrying a seat for seating a child; a first and a second support leg disposed between the base frame and the seat frame for supporting the seat frame; a first and a second connecting structure for coupling the seat frame to an upper end of the first and second support legs, respectively; wherein a lower end of each support leg has a lower straight section rotatably coupled to the base frame, and an upper end of each support leg has an upper straight section rotatably coupled to a corresponding connecting structure, wherein rotation axes of the lower straight sections and the upper straight sections of the first and second support legs are parallel to each other; and a drive mechanism for driving one or more relative rotations of: the lower straight sections of the first and second support legs with respect to the base frame, and the upper straight sections of the first and second support legs with respect to the corresponding connection structures.

In one embodiment, the drive mechanism is located in the base frame and drives relative rotations of the lower straight sections of the first and second support legs with respect to the base frame. In another embodiment, the drive mechanism drives relative rotations of the upper straight sections of the first and second support legs with respect to the first and second connecting structure, respectively.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

It is to be understood that both the foregoing general description and the following detailed description are exemplary and explanatory and are intended to provide further explanation of the invention as claimed.

DETAILED DESCRIPTION OF THE PREFERRED EMBODIMENTS

FIGS. 1-4 illustrate a baby swing and bouncer according to a first embodiment of the present invention.

Figure 1:
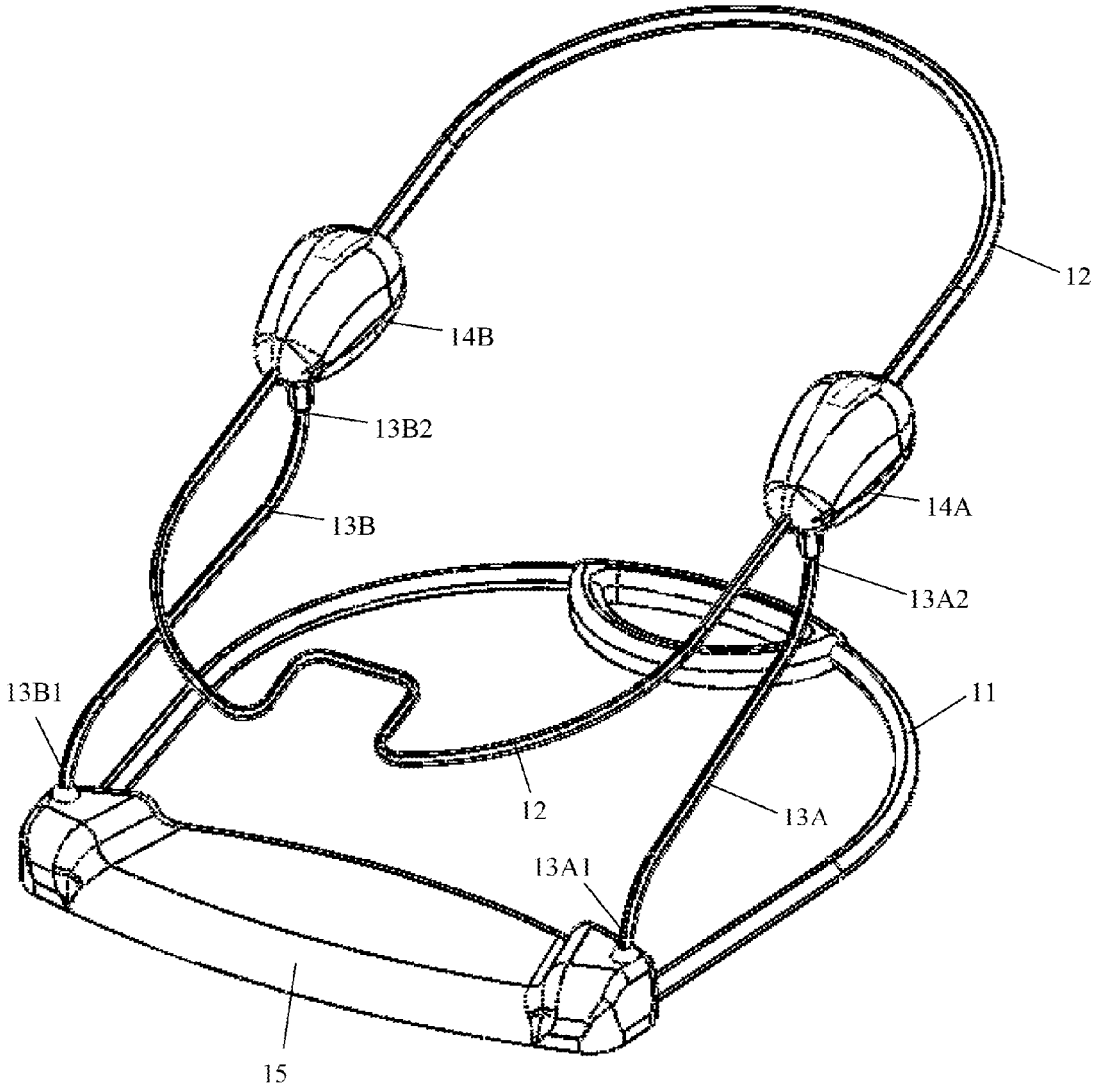
FIGS. 1, 1A and 1B illustrate perspective, top and bottom views of a swing and bouncer according to a first embodiment of the present invention.
Figure 1A:
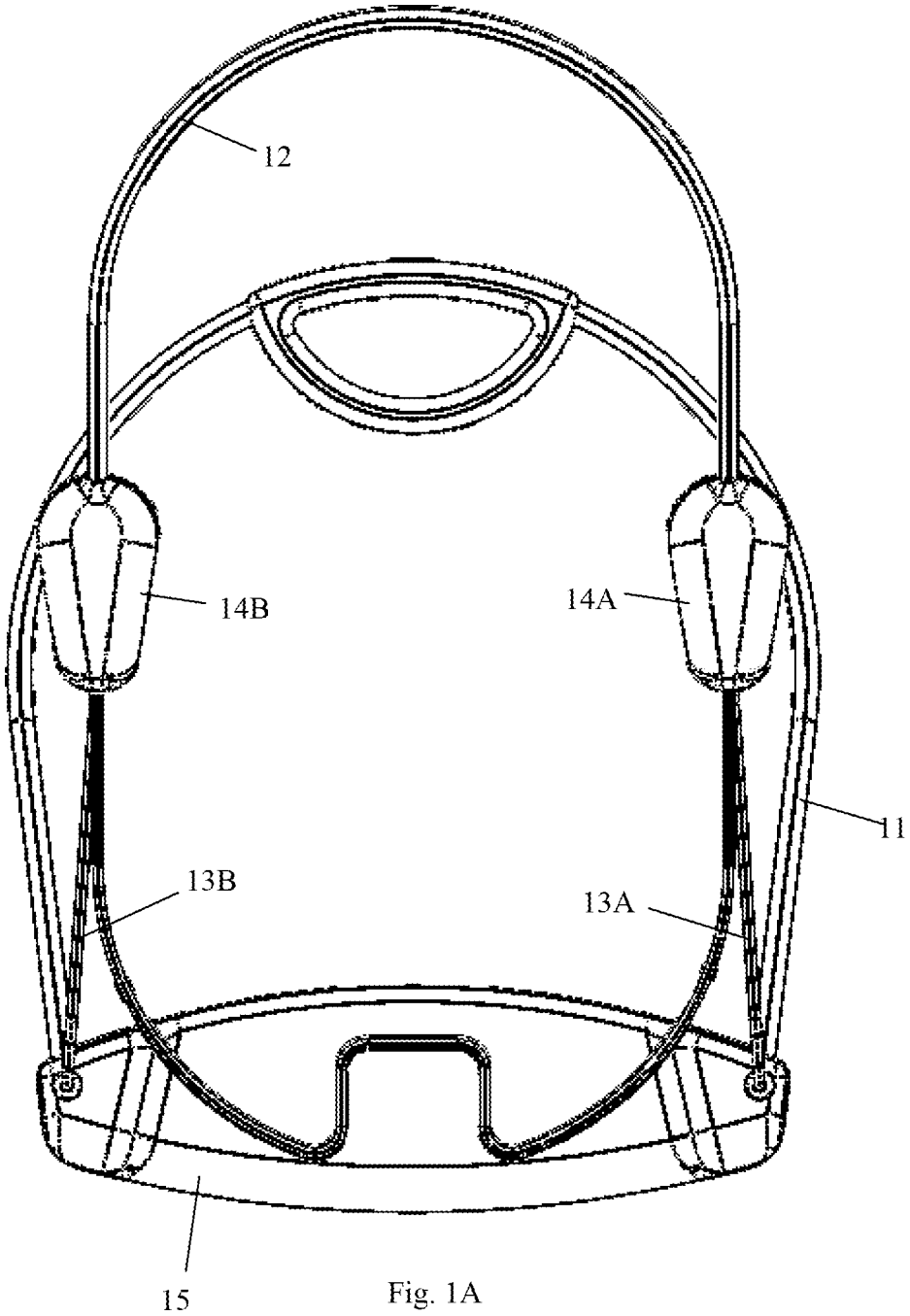
Figure 1B:
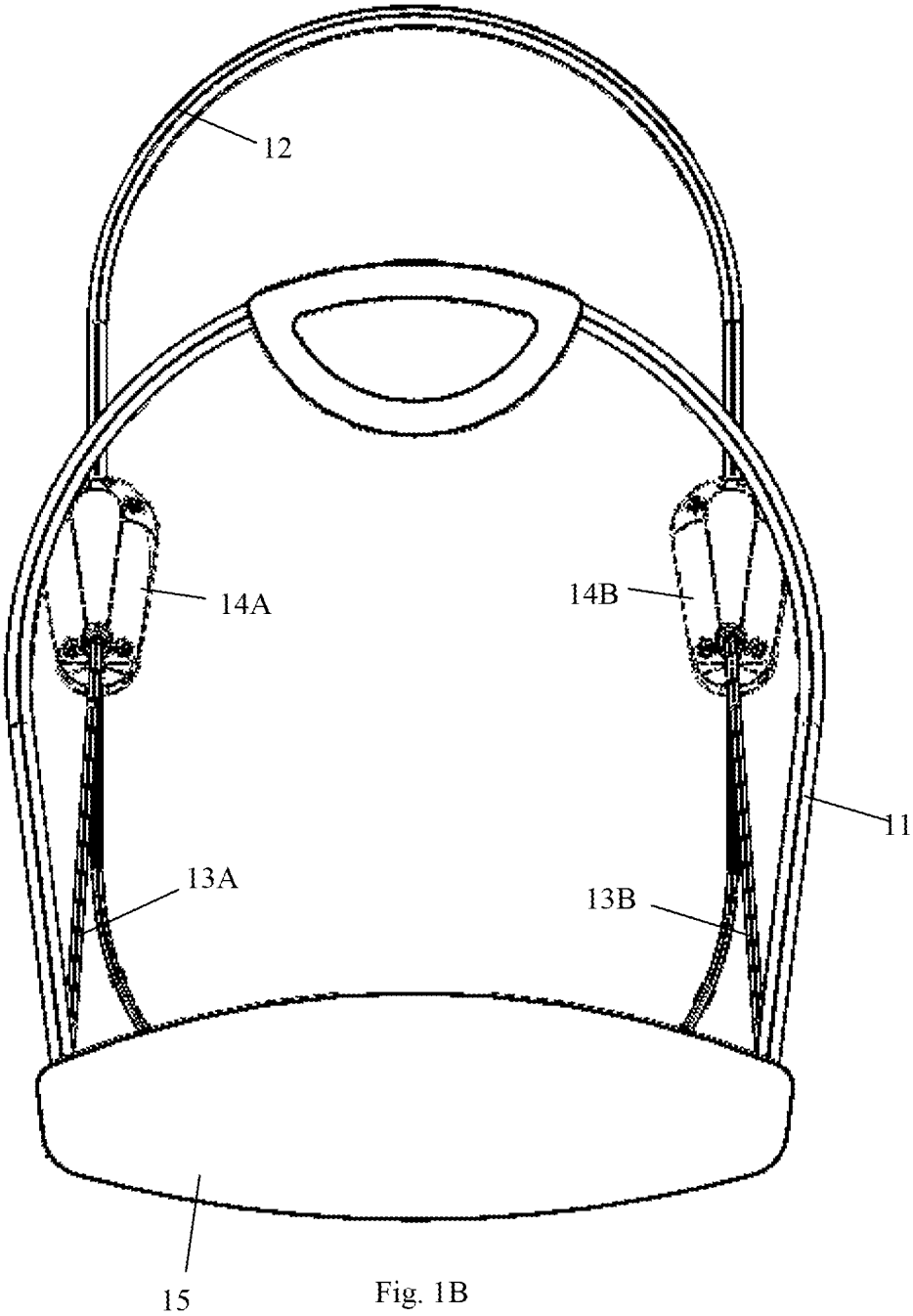

As shown in FIGS. 1, 1A and 1B, the baby swing and bouncer includes a base frame 11 to be places on the ground or other surface, a seat frame 12 for carrying a seat for seating a child, and two support legs 13A and 13B disposed between the base frame 11 and the seat frame 12 for supporting the seat frame. The two support legs 13A and 13B preferably have shapes that are symmetrical to each other with respect to a vertical longitudinal center plane of the swing and bouncer. Two connecting structures 14A, 14B couple the seat frame 12 to the upper ends of the support legs 13A and 13B, respectively.

The lower end of each support leg 13A, 13B has a lower straight section 13A1, 13B1, respectively, which is rotatably coupled to a part of the base frame 11. The upper end of each support leg 13A, 13B has an upper straight section 13A2, 13B2, respectively, which is rotatably coupled to the connecting structure 14A, 14B, respectively. The rotation axes of the lower straight sections 13A1, 13B1 and the rotation axes of the upper straight sections 13A2, 13B2 are all parallel to each other. Preferably, they are all vertical. In one embodiment, when viewed along the direction of the rotation axes, the four rotation axes mentioned above form the vertices of a parallelogram. In another embodiment, when viewed along the direction of the rotation axes, the four rotation axes mentioned above form the vertices of a trapezoid. When the four straight sections 13A1, 13B1, 13A2, and 13B2 rotate relative to the respective structures they are coupled to, the seat frame 12 swings. For example, if the four rotation axes form the vertices of a parallelogram, the seat frame will swing in a translational motion (i.e. without rotation) where every point of the seat frame moves in an arc shaped path. If the four rotation axes form the vertices of a four-sided polygon other than a parallelogram, the swing of the seat frame may have a translational motion as well as a rotation. It should be noted that the materials forming the support legs 13A, 13B and the seat frame 12 are not completely rigid and can deform slightly if it is necessary to accommodate the swinging motion.

One or more of the four straight sections 13A1, 13B1, 13A2, and 13B2 is driven to cause the seat frame 12 to swing. Due do the interconnectedness of the two support legs 13A, 13B via the base frame 11 and the seat frame 12, when at least one of the four straight sections is driven to rotate, all four straight sections will rotate and the support legs 13A, 13B will swing.

Figure 2:
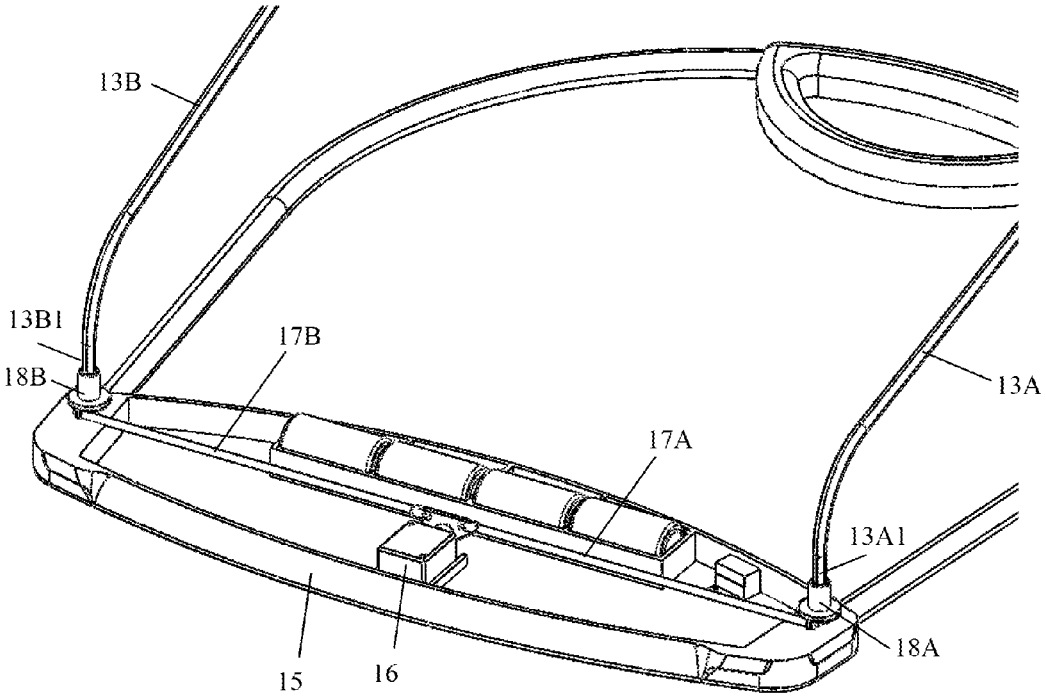
FIGS. 2-4 illustrate a drive mechanism of the swing and bouncer of the first embodiment.
Figure 3:
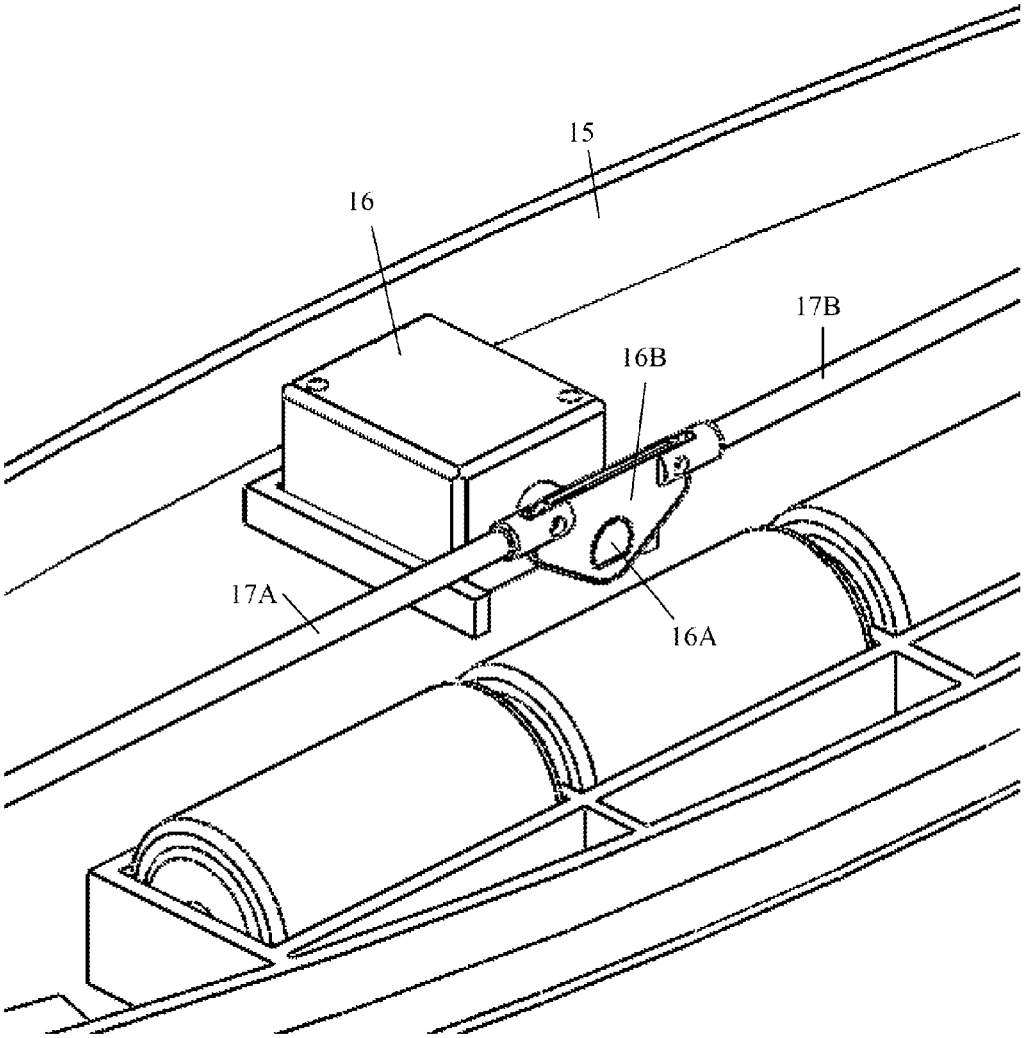
Figure 4:
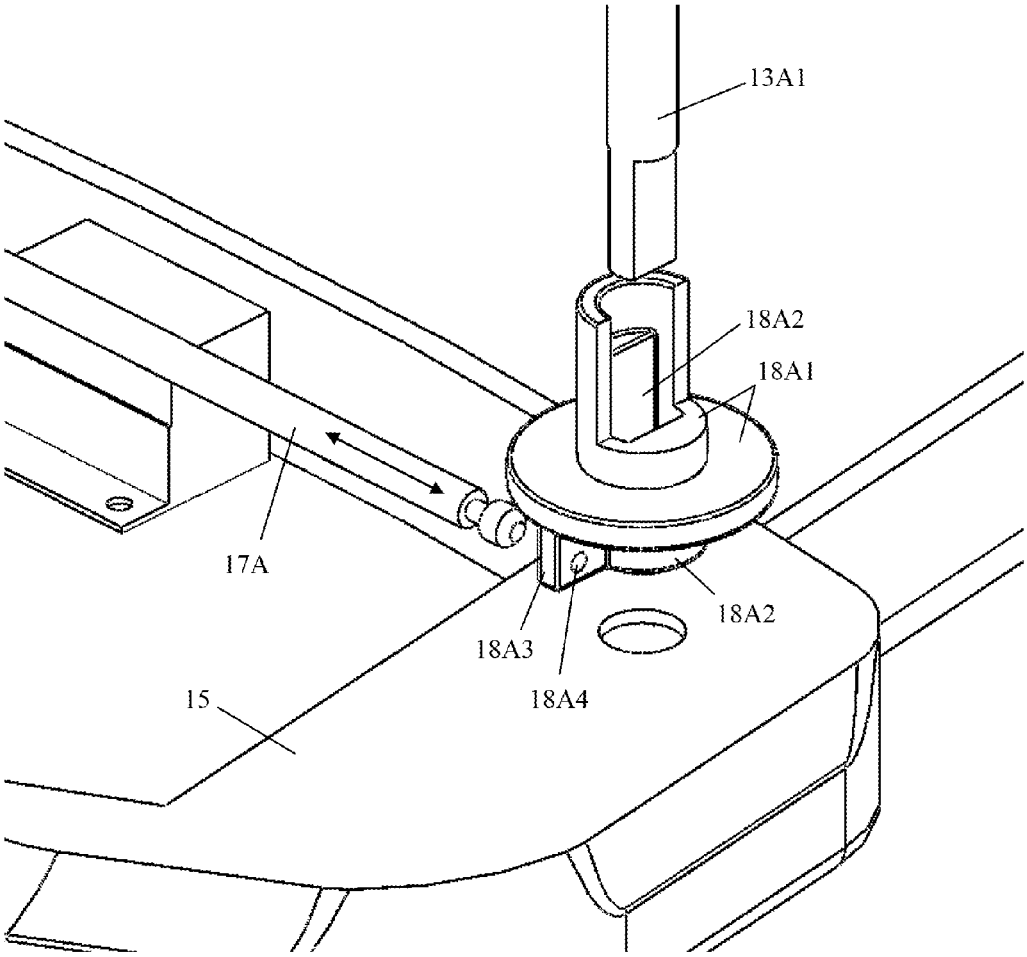

In the embodiment shown in FIGS. 1-4, the lower straight sections 13A1 and 13B1 are driven to rotate by a drive mechanism located in a drive housing 15 attached to the base frame 11, shown in detail in FIGS. 2-4. In FIGS. 2-4, a cover of the drive housing 15 is removed to expose the interior structure. The drive mechanism includes a drive motor 16 with a motor shaft 16A which rotate in an oscillating manner by a predefined amount. The motor 16 is controlled by a motor control circuit (not shown) disposed within the housing 15. A tab 16B is attached to the motor shaft 16A, and are also attached to the first end of two drive rods 17A and 17B, respectively. The drive rods 17A, 17B are disposed substantially horizontally; as the drive draft 16A of the motor oscillates, the rods 17A, 17B move back and forth longitudinally in a substantially horizontal direction. The second end of each drive rod 17A, 17B is coupled to a bearing assembly 18A, 18B for the lower straight section 13A1 and 13B1 of the two support legs, respectively.

FIG. 4 is an exploded view showing how the second end of the drive rod 17A is coupled to the bearing structure 18A. The bearing structure 18A includes a stationary member 18A1 which is fixedly mounted to the drive housing 15, and a rotating member 18A2 which can rotate with respect to the stationary member 18A1. In the illustrated embodiment, the rotating member 18A2 is disposed inside the stationary member 18A1, but the reverse is also possible. The rotating member 18A2 has a tab 18A3 disposed in a radial direction. The second end of the rod 17A is coupled to the tab 18A3. In the illustrated embodiment, the rod 17A has a neck portion near its end which passes through a through hole 18A4 on the tab 18A3, but other suitable ways of coupling the end of the rod 17A to the tab 18A3 may be used.

As the rod 17A is driven by the motor 16 and moves longitudinally as shown by the double-headed arrow in FIG. 4, the rod 17A drives the rotating member 18A2 via the tab 18A3 to rotate in an oscillating motion. An upper part of the rotating member 18A2 is coupled to the lower straight section 13A1 of the support leg 13A. In the illustrated embodiment, the end of the lower straight section 13A1 has a non-circular shape which fits into a space having a mating shape created by the rotating member 18A2. Thus, the lower straight section 13A1 rotates together with the rotating member 18A2, so that the rotation (oscillation) of the rotating member 18A2 is transferred to the lower straight section 13A1 of the support leg 13A. Other suitable ways of coupling the rotating member 18A2 and the lower straight section 13A1 may be used, including forming the rotating member and the lower straight section 13A1 in one piece. The coupling method of the illustrated embodiment has the advantage that the support leg can be easily assembled and disassembled by inserting the lower straight section 13A1 into and pulling it out of the bearing structure 18A.

The coupling between the upper straight sections 13A2, 13B2 and the respective connecting structure 14A, 14B may be by simple bearings and the relative rotation between them is passive, i.e. not driven by a drive means. The seat frame 12 is fixedly jointed to the connecting structure 14A, 14B.

The amount of desired rotation (oscillation) of the motor 16 is determined by the desired amount of swing of the support legs 13A, 13B and the geometry of the drive mechanism (e.g. the location of the through hole 18A4 on the tab 18A3, the locations where the first end of the rods 17A, 17B join the tab 16B of the motor 16, etc.). In a preferred embodiment, the amount of swing of the support legs 13A, 13B is approximately 5-10 degrees in either direction. The amount of lateral motion of the seat frame 12 and the seat mounted on it is determined by the angular amount or swing of the support legs 13A, 13B and the distance between the rotation axes of the lower and upper straight sections 13A1 and 13A2 (or 13B1 and 13B2).

In the embodiment of FIG. 2, the motor 16 is located near the center of the drive housing 15, but it may be located at other locations as well.

While in the embodiment shown in FIGS. 2 and 3 both bearing assemblies 18A, 18B are driven by the motor 16, it is possible to drive The support legs 13A, 13B are preferably made of metal with a desired degree of resilience so that the seat frame 12 and the seat mounted on it can bounce up and down.

Figure 5:
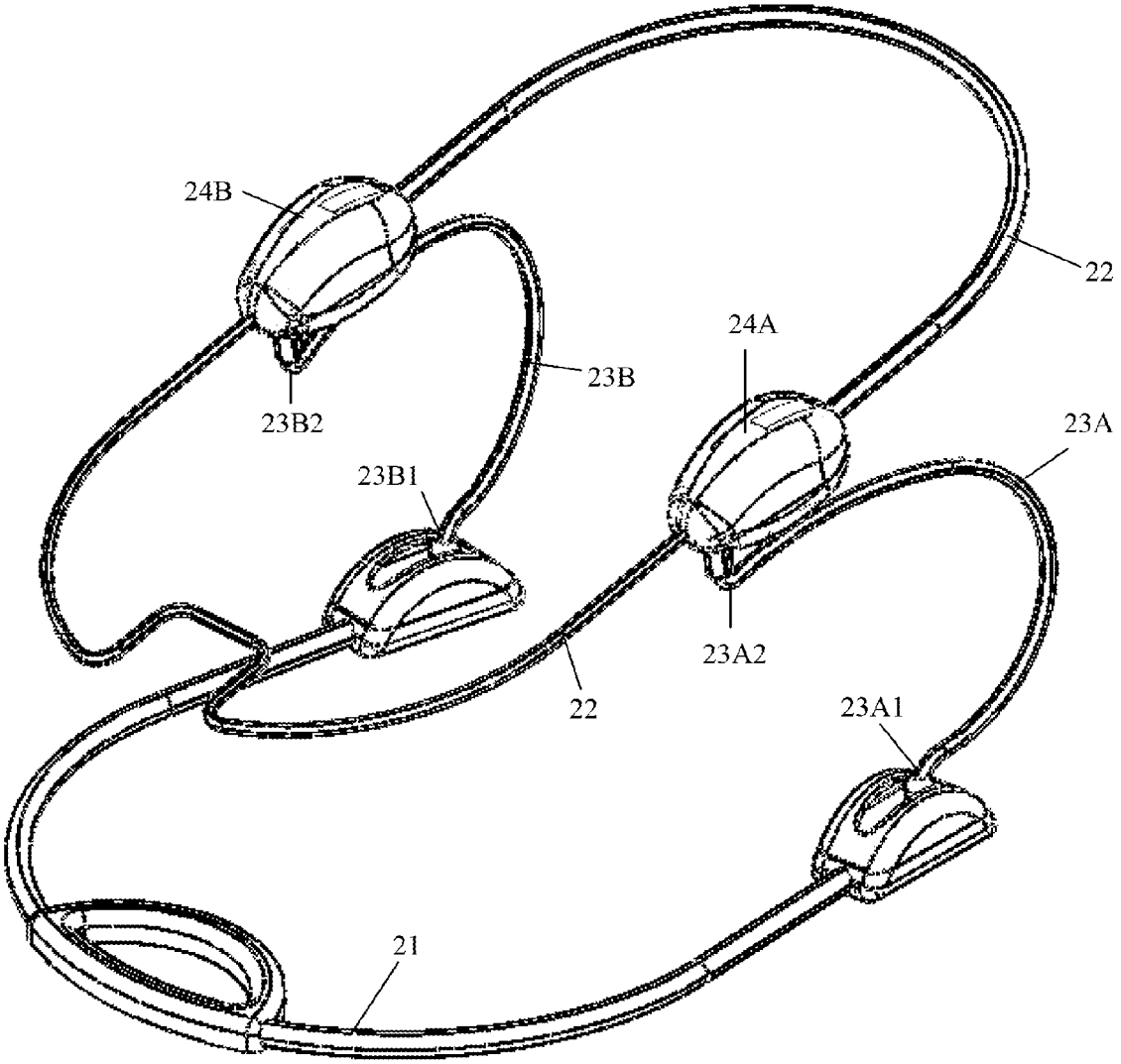
FIGS. 5, 5A and 5B illustrate perspective, top and bottom views of a swing and bouncer according to a second embodiment of the present invention.
Figure 6:
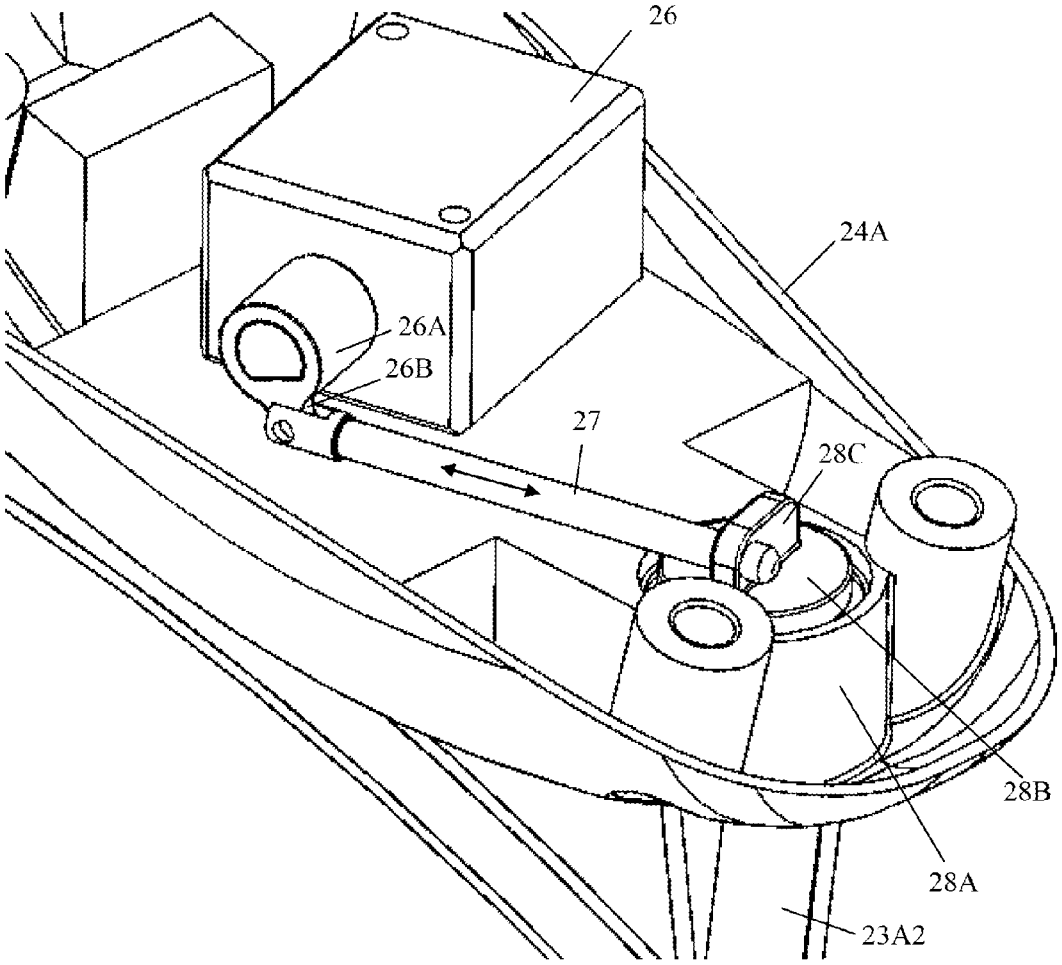
FIGS. 6-7 illustrate a drive mechanism of the swing and bouncer of the second embodiment.
Figure 7:
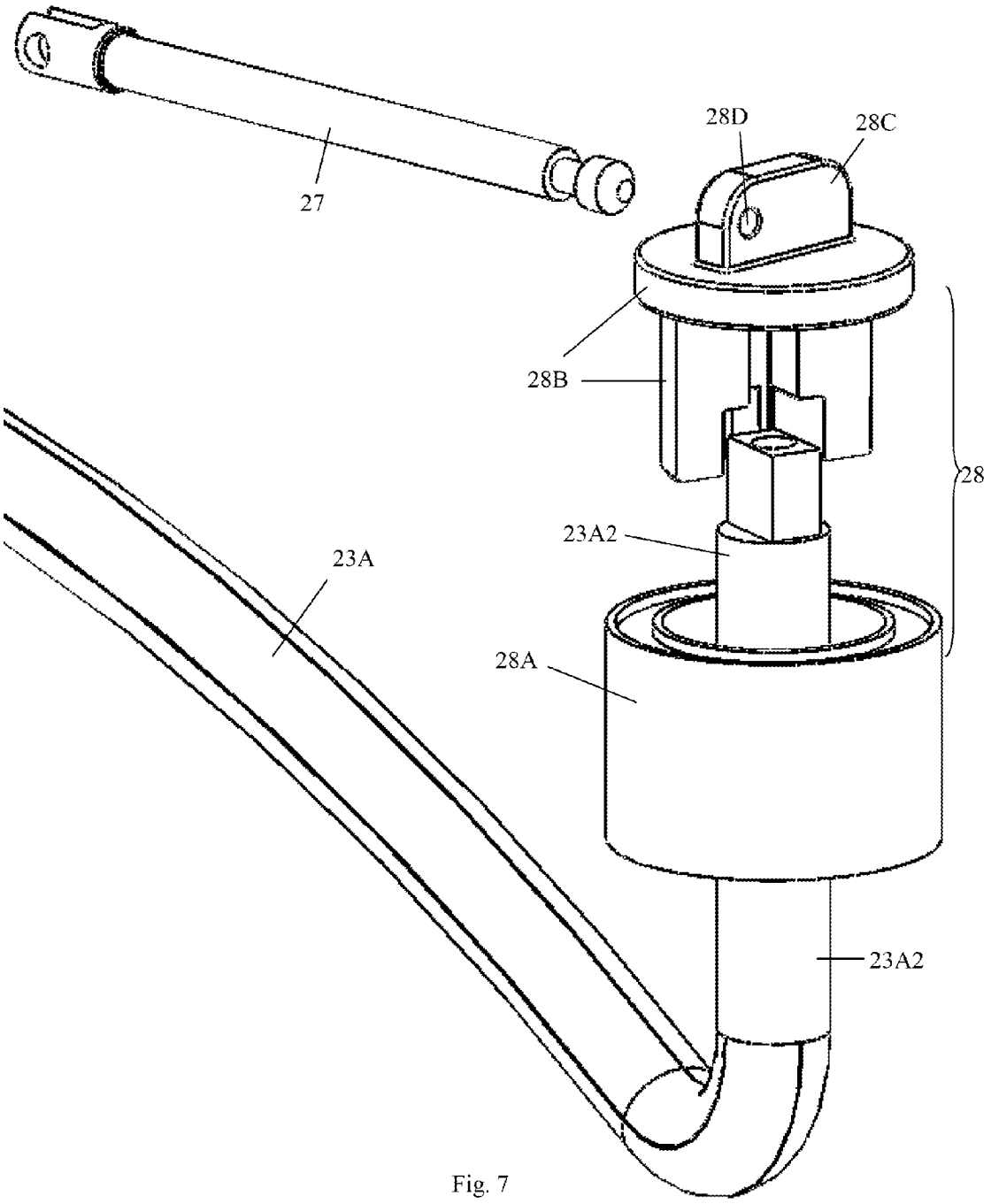

FIGS. 5-7 illustrate a baby swing and bouncer according to a second embodiment of the present invention. The general structure of the second embodiment is similar to the first embodiment but the drive mechanism is different.

Figure 5A:
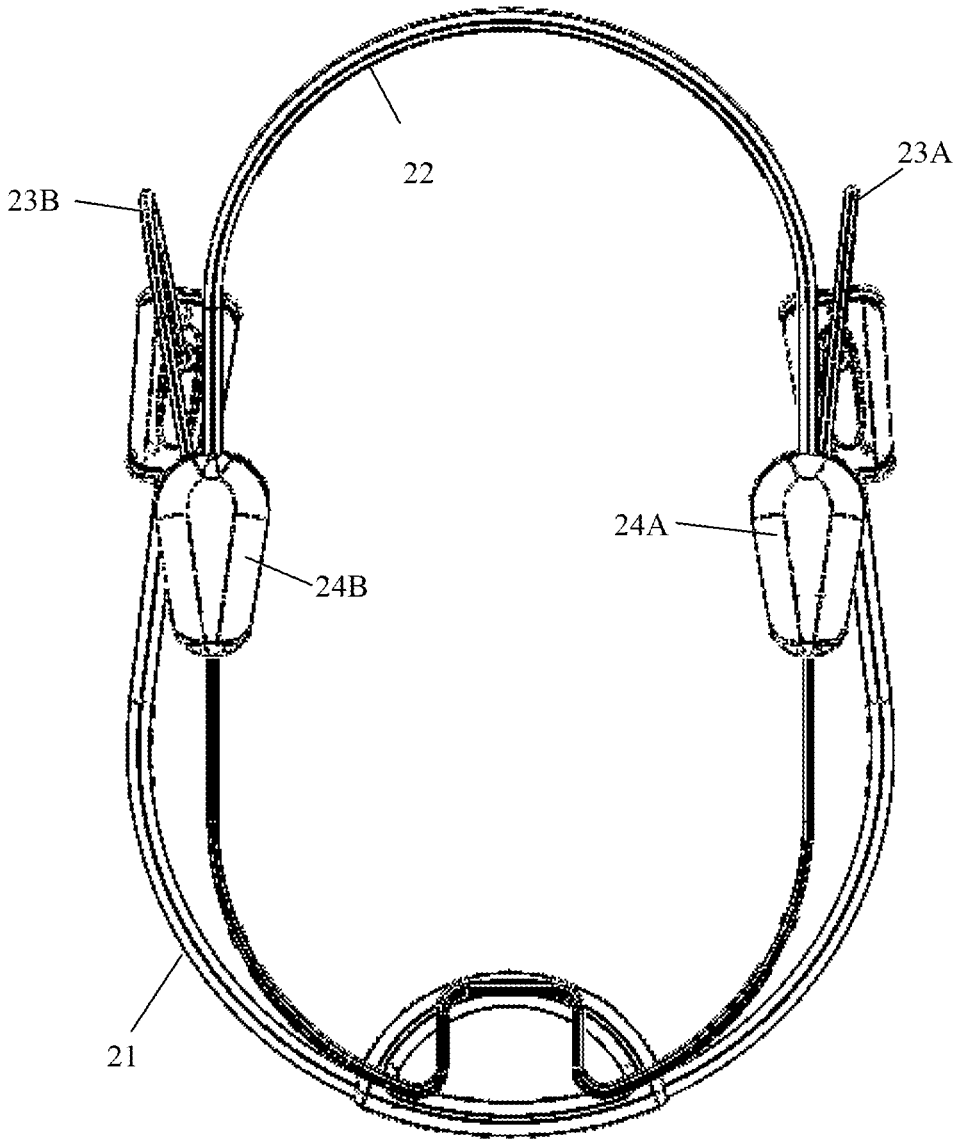
Figure 5B:
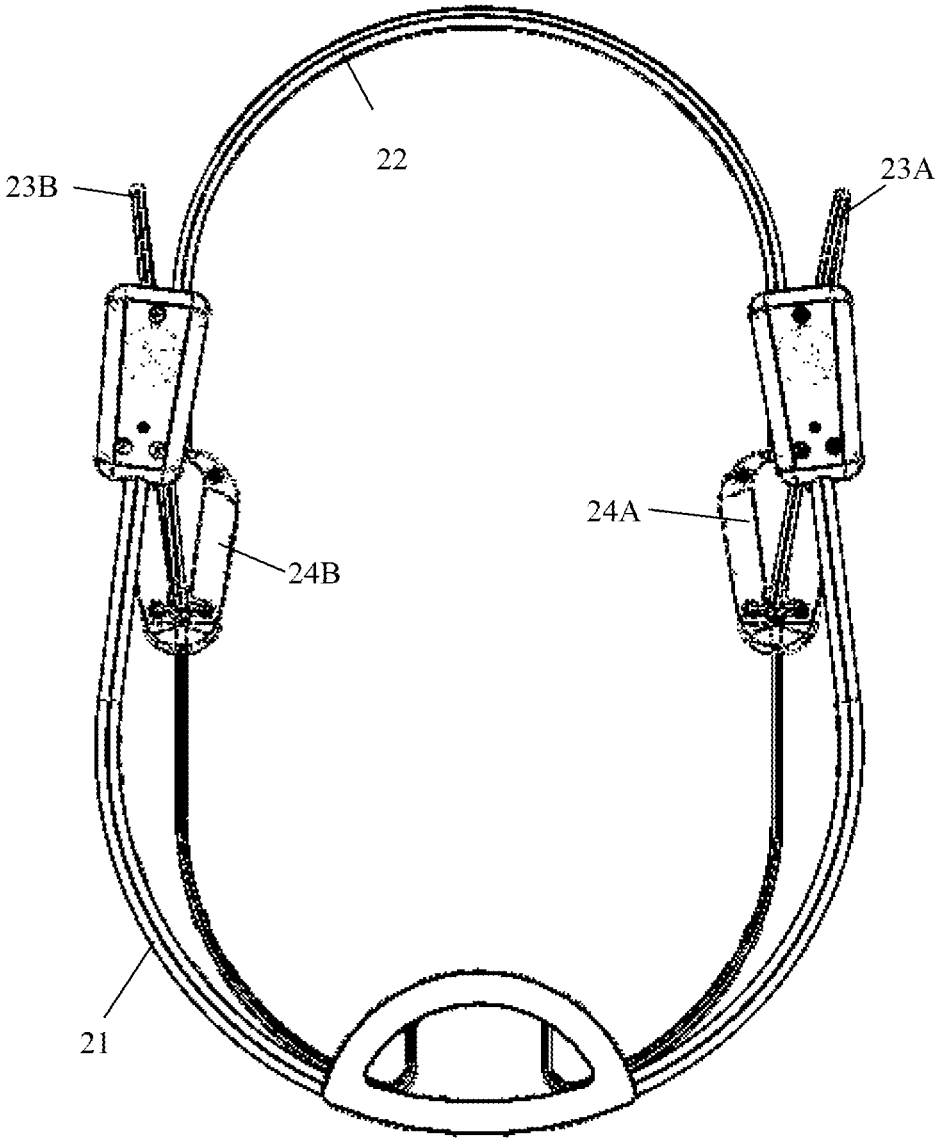

As shown in FIGS. 5, 5A and 5B, the baby swing and bouncer of the second embodiment includes a base frame 21 to be places on the ground or other surface, a seat frame 22 for carrying a seat for seating a child, and two support legs 23A and 23B disposed between the base frame 21 and the seat frame 22 for supporting the seat frame. The two support legs 23A and 23B preferably have shapes that are symmetrical to each other with respect to a vertical longitudinal center plane of the swing and bouncer. Two connecting structures 24A, 24B couple the seat frame 22 to the upper ends of the support legs 23A and 23B, respectively.

The lower end of each support leg 23A, 23B has a lower straight section 23A1, 23B1, respectively, which is rotatably coupled to a part of the base frame 21. The upper end of each support leg 23A, 23B has an upper straight section 23A2, 23B2, respectively, which is rotatably coupled to the connecting structure 24A, 24B, respectively. The rotation axes of the lower straight sections 23A1, 23B1 and the rotation axes of the upper straight sections 23A2, 23B2 are all parallel to each other. Preferably, they are all vertical. In one embodiment, when viewed along the direction of the rotation axes, the four rotation axes mentioned above form the vertices of a parallelogram. In another embodiment, when viewed along the direction of the rotation axes, the four rotation axes mentioned above form the vertices of a trapezoid. When the four straight sections 23A1, 23B1, 23A2, and 23B2 rotate relative to the respective structures they are coupled to, the seat frame 22 swings. For example, if the four rotation axes form the vertices of a parallelogram, the seat frame will swing in a translational motion (i.e. without rotation) where every point of the seat frame moves in an arc shaped path. If the four rotation axes form the vertices of a four-sided polygon other than a parallelogram, the swing of the seat frame may have a translational motion as well as a rotation. It should be noted that the materials forming the support legs 13A, 13B and the seat frame 12 are not completely rigid and can deform slightly if it is necessary to accommodate the swinging motion.

One or more of the four straight sections 23A1, 23B1, 23A2, and 23B2 is driven to cause the seat frame 22 to swing. Due do the interconnectedness of the two support legs 23A, 23B via the base frame 21 and the seat frame 22, when at least one of the four straight sections is driven to rotate, all four straight sections will rotate and the support legs 23A, 23B will swing.

In the embodiment shown in FIGS. 5-7, the upper straight sections 23A1 and 23B1 of the support legs 23A, 23B are driven to rotate by drive mechanisms located in the connecting structures 14A and 14B, respectively. The two drive mechanisms are preferably identical.

In FIG. 6, a cover of the connecting structure 24A is removed to show in the interior structures. The drive mechanism includes a drive motor 26 with a motor shaft 26A which rotate in an oscillating manner by a predefined amount. A tab 26B are attached to the motor shaft 26A, and is also attached to the first end of a drive rod 27. As the drive draft 26A of the motor oscillates, the rod 27 moves back and forth longitudinally as indicated by the double-headed arrow in FIG. 6. The second end of the drive rod 27 is coupled to a bearing assembly 28 for the upper straight section 23A2 of the support leg 23A.

FIG. 8 is an exploded view showing how the second end of the drive rod 27 is coupled to the bearing structure 28. The bearing assembly 28 includes a stationary member 28A which is fixedly mounted to the connecting structure 24A, and a rotating member 28B which can rotate with respect to the stationary member 28A. In the illustrated embodiment, the rotating member 28B is disposed inside the stationary member 28A, but the reverse is also possible. The second end of the rod 27 is coupled to the rotating member 28B at a location which is offset from the rotation axis of the rotating member 28B. In the illustrated embodiment, the rotating member 28B has a tab 28C with a through hole 28D; the location of the through hole is offset from the rotation axis. The rod 27 has a neck portion near its end which passes through a through hole 28D. Other suitable ways of coupling the end of the rod 27 to the rotating member 28B may be used. As shown in FIG. 6, the rod 27 drives the rotating member 28B via the tab 28C to rotate in an oscillating motion.

As shown in FIG. 7, a lower part of the rotating member 28B is coupled to the upper straight section 23A2 of the support leg 23A. In the illustrated embodiment, the end of the upper straight section 23A2 has a non-circular shape which fits into a space having a mating shape created by the rotating member 28B. Thus, the upper straight section 23A2 rotates together with the rotating member 28B, so that the rotation (oscillation) of the rotating member 28B is transferred to the upper straight section 23A2 of the support leg 23A. Other suitable ways of coupling the rotating member 28B and the upper straight section 23A2 may be used, including forming the rotating member and the upper straight section in one piece. The coupling method of the illustrated embodiment has the advantage that the support leg 23A and the seat frame 22 can be easily assembled and disassembled by inserting the upper straight section 23A2 into and pulling it out of the bearing structure 28.

The coupling between the lower straight sections 23A1, 23B1 and the base frame 21 may be by simple bearings and the relative rotation between them is passive, i.e. not driven by a drive means. The seat frame 22 is fixedly jointed to the connecting structure 24A, 24B.

The amount of desired rotation (oscillation) of the motor 26 is determined by the desired amount of swing of the support legs 23A, 23B and the geometry of the drive mechanism (e.g. the location of the through hole 28D on the tab 28C, the locations where the first end of the rod 27 joins the tab 26B of the motor 26, etc.). In a preferred embodiment, the amount of swing of the support legs 23A, 23B is approximately 5-10 degrees in either direction. The amount of lateral motion of the seat frame 22 and the seat mounted on it is determined by the angular amount or swing of the support legs 23A, 23B and the distance between the rotation axes of the lower and upper straight sections 23A1 and 23A2 (or 23B1 and 23B2).

Figure 8A:
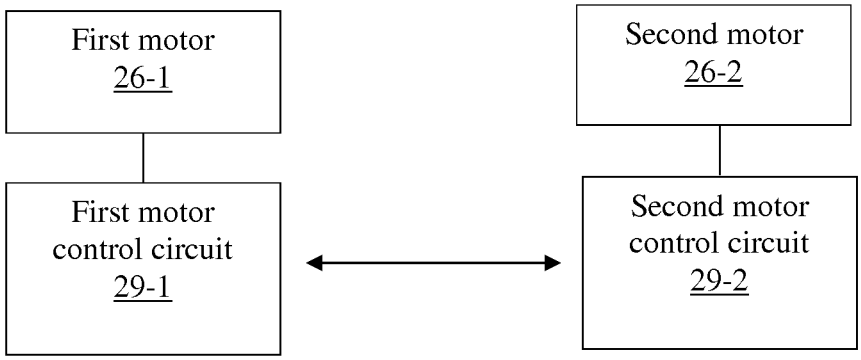
FIGS. 8A-8C schematically illustrate motors and motor control circuits according to three embodiments of the present invention.
Figure 8B:
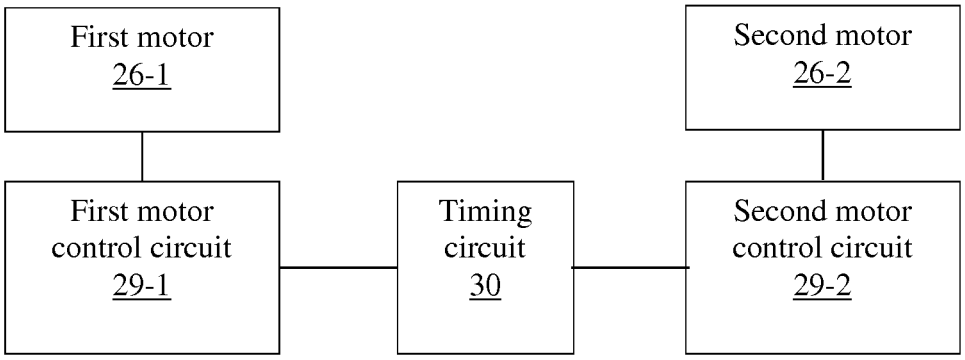
Figure 8C:
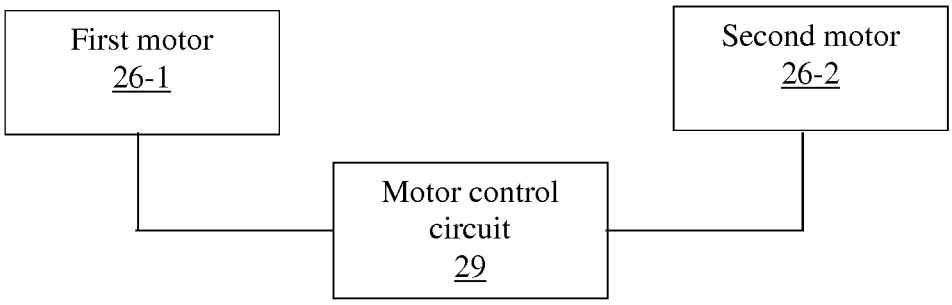

The motor 26 in each connecting structure 24A, 24B is controlled by a motor control circuit disposed within the connecting structure. Because the swinging motion of the two support legs 23A, 23B must be synchronized to have the same phase, a means to synchronize the two motors is provided. This may be accomplished by exchanging signals between the two motor control circuits by a wired (e.g. a wire that goes in the seat frame 22) or wireless signal channel, as schematically shown in FIG. 8A, where the two motors 26-1 and 26-2 are controlled by two motor control circuits 29-1 and 29-2 respectively; by using a common timing circuit to supply a timing signal to both motor control circuits, as schematically shown in FIG. 8B, where the timing circuit is indicated at 30; or by using a single motor control circuit to control both motors (if the single motor control circuit is located in one of the connector structures 24A, 24B, the signal may be transmitted to the other motor by a wired or wireless channel), as schematically shown in FIG. 8C, where the single motor control circuit is indicated at 29. The collection of circuits that control both motors may be referred to as motor control circuitry or motor control means.

The support legs 23A, 23B are preferably made of metal with a desired degree of resilience so that the seat frame 22 and the seat mounted on it can bounce up and down.

Although in the first embodiment shown in FIGS. 1-4 a single motor 16 is used to drive the rotation of the lower straight section 13A1, 13B1 of both the first and second support legs, two motors may be used to separately drive the two lower straight sections. In such a case, the two motors should be synchronized as discussed above.

The drive rods 17A, 17B in the first embodiment and 27 in the second embodiment may have other shapes and structures than a rod, so long as they operate to transmit the oscillation motion of the motor shaft into an oscillation motion of the rotating member 18A2, 28B of the bearing structure 18, 28. The design of these structures, which may be generally referred to as a transmission structure, depends on the placement of the motor as well. For example, in an alternative of the second embodiment, the motor 26 may be disposed such that its rotating shaft is parallel to the rotation axis of the upper straight section 23A2, and the rotation (oscillation) of the motor shaft is transferred into the rotation (oscillation) of the rotating member 28B by gears. Similar structures may be implemented in the first embodiment.

If should be noted that although the external shapes of the baby swing and bouncer of the first and second embodiments (FIG. 1 and FIG. 5) are different, such difference is not important. The drive mechanism of the first embodiment which is located in the base frame may be used in a swing and bounder having the shape shown in FIG. 5; conversely, the drive mechanism of the second embodiment which is located in the connecting structures may be used in a swing and bounder having the shape shown in FIG. 1.

Regarding the second embodiment, it is noted that driving the support legs 23A, 23B at the distal ends (i.e. at the end located away from the stationary base frame 21) is possible due to the interconnectedness of the two support legs via the seat frame 22. If only one support leg is used and a drive mechanism drives the distal end of the single support leg to rotate, e.g., with respect to a seat supported at the distal end of the leg, then the seat will rotate but the leg will not swing.

It will be apparent to those skilled in the art that various modification and variations can be made in the baby swing and bouncer of the present invention without departing from the spirit or scope of the invention. Thus, it is intended that the present invention cover modifications and variations that come within the scope of the appended claims and their equivalents.

What is claimed is:

1. A baby swing and bouncer comprising:

a base frame to be placed on a surface;

a seat frame for carrying a seat for seating a child;

a first and a second support leg disposed between the base frame and the seat frame for supporting the seat frame;

a first and a second connecting structure for coupling the seat frame to an upper end of the first and second support legs, respectively;

wherein a lower end of each support leg has a lower straight section rotatably coupled to the base frame, and an upper end of each support leg has an upper straight section rotatably coupled to a corresponding connecting structure, wherein rotation axes of the lower straight sections and the upper straight sections of the first and second support legs are parallel to each other; and a drive mechanism for driving one or more relative rotations of: the lower straight sections of the first and second support legs with respect to the base frame, and the upper straight sections of the first and second support legs with respect to the corresponding connection structures.

2. The baby swing and bouncer of claim 1, wherein the drive mechanism drives relative rotations of the lower straight sections of the first and second support legs with respect to the base frame.

3. The baby swing and bouncer of claim 2, further comprising:

a first and a second bearing structures for coupling the lower straight sections of the first and second support legs, respectively, to the base frame, each of the first and second bearing structures including a stationary member fixedly mounted on the base frame and a rotating member rotatbly disposed with respect to the stationary member, wherein the lower straight sections of the first and second support legs are respectively coupled to and rotates together with the rotating members of the first and second bearing structures, wherein the drive mechanism includes:

a motor with a shaft that rotates in an oscillation motion;

a transmission structure for transferring the rotation of the motor shaft into rotations of the rotating members of the first and second bearing structures.

4. The baby swing and bouncer of claim 3, wherein the transmission structure includes a first and a second drive rod, a first end of each drive rod being coupled to the rotating shaft of the motor, and a second end of each drive rod being coupled to the rotating member of a respective one of the first and second bearing structures at locations offset from the respective rotation axis of the corresponding lower straight section.

5. The baby swing and bouncer of claim 1, wherein the drive mechanism drives relative rotations of the upper straight sections of the first and second support legs with respect to the first and second connecting structure, respectively.

6. The baby swing and bouncer of claim 5, wherein the first connecting structure comprises:

a bearing structure for coupling the upper straight section of the first support leg to the first connecting structure, the bearing structures including a stationary member fixedly mounted on the first connecting structure and a rotating member rotatbly disposed with respect to the stationary member, wherein the upper straight section of the first support leg is coupled to and rotates together with the rotating member;

a motor with a shaft that rotates in an oscillation motion;

a transmission structure for transferring the rotation of the motor shaft into a rotation of the rotating members of the bearing structure.

7. The baby swing and bouncer of claim 6, wherein the transmission structure includes a drive rod, a first end of the drive rod being coupled to the rotating shaft of the motor, and a second end of the drive rod being coupled to the rotating member of the bearing structure at a location offset from the rotation axis of the upper straight section of the first support leg.

8. The baby swing and bouncer of claim 5, wherein the first connecting structure includes a first motor located within the first connecting structure for driving a relative rotation of the upper straight sections of the first support leg with respect to the first connecting structure, the second connecting structure includes a second motor located within the second connecting structure for driving a relative rotation of the upper straight sections of the second support leg with respect to the second connecting structure.

9. The baby swing and bouncer of claim 8, wherein the drive mechanism further includes a first motor control circuit disposed in the first connecting structure for controlling the first motor, a second motor control circuit disposed in the second connecting structure for controlling the second motor, and a common timing circuit which supplies a timing signal to the first and second motor control circuits to synchronously control the first and second motors.

10. The baby swing and bouncer of claim 8, wherein the drive mechanism further includes a motor control circuit disposed in the first or second connecting structure which transmits signals to the first and second motors to synchronously control the first and second motors.

11. The baby swing and bouncer of claim 8, wherein the drive mechanism further includes a first motor control circuit disposed in the first connecting structure for controlling the first motor and a second motor control circuit disposed in the second connecting structure for controlling the second motor, wherein the first and second motor control circuits exchange signals with each other to synchronously control the first and second motors.

* * * * *